US010021980B2

(12) United States Patent
Lawson

(10) Patent No.: US 10,021,980 B2
(45) Date of Patent: Jul. 17, 2018

(54) ZERO-WALL CLEARANCE LINKAGE MECHANISM WITH POWER SEAT DRIVE

(71) Applicant: L&P PROPERTY MANAGEMENT COMPANY, South Gate, CA (US)

(72) Inventor: Gregory M. Lawson, Tupelo, MS (US)

(73) Assignee: L&P Property Management Company, South Gate, CA (US)

( * ) Notice: Subject to any disclaimer, the term of this patent is extended or adjusted under 35 U.S.C. 154(b) by 245 days.

(21) Appl. No.: 14/804,400

(22) Filed: Jul. 21, 2015

(65) Prior Publication Data

US 2016/0022040 A1 Jan. 28, 2016

Related U.S. Application Data

(60) Provisional application No. 62/027,437, filed on Jul. 22, 2014.

(51) Int. Cl.
*A47C 1/035* (2006.01)
*A47C 1/032* (2006.01)
*A47C 1/0355* (2013.01)

(52) U.S. Cl.
CPC ..... *A47C 1/0355* (2013.01); *A47C 1/03211* (2013.01)

(58) Field of Classification Search
CPC ..... A47C 1/035; A47C 1/0352; A47C 1/0355; A47C 1/03211; A47C 1/03205; A47C 1/0342
USPC ..... 297/317, 329, 341, 342, 343
See application file for complete search history.

(56) References Cited

U.S. PATENT DOCUMENTS

| | | | | |
|---|---|---|---|---|
| 5,165,753 | A | 11/1992 | Henderson | |
| 5,992,931 | A * | 11/1999 | LaPointe | A47C 1/0345 297/330 |
| 6,409,262 | B1 * | 6/2002 | LaPointe | A47C 1/0352 297/452.18 |
| 8,573,687 | B2 * | 11/2013 | Lawson | A47C 1/0355 297/84 |
| 9,277,823 | B2 * | 3/2016 | Griggs, Jr. | A47C 1/0355 |
| 9,408,466 | B2 * | 8/2016 | Flamme | A47C 1/0242 |
| 9,590,465 | B2 * | 3/2017 | Marcantoni | A47C 20/041 |
| 2001/0033101 | A1 * | 10/2001 | Plant | A47C 1/0352 297/342 |
| 2006/0061148 | A1 * | 3/2006 | Pollard | A47C 1/0355 297/85 M |
| 2011/0181094 | A1 | 7/2011 | Lawson et al. | |
| 2011/0193373 | A1 * | 8/2011 | Lawson | A47C 1/035 297/71 |

(Continued)

FOREIGN PATENT DOCUMENTS

CN 103637579 A 3/2014

OTHER PUBLICATIONS

International Search Report with Written Opinion dated Oct. 16, 2015 in Application No. PCT/US15/41563, 8 pages.

(Continued)

*Primary Examiner* — Timothy J Brindley
(74) *Attorney, Agent, or Firm* — Shook, Hardy & Bacon, LLP

(57) ABSTRACT

A seating unit that includes a linkage mechanism adapted to adjust between closed, extended, and reclined positions is provided. The linkage mechanism includes a linear actuator primarily coupled to a seat mounting plate for carrying out automated adjustment of the linkage assembly.

13 Claims, 19 Drawing Sheets

(56) References Cited

U.S. PATENT DOCUMENTS

2011/0248547 A1* 10/2011 LaPointe ..... A47C 1/0355 297/85 R
2012/0049606 A1 3/2012 Lawson et al.
2012/0112519 A1* 5/2012 Murphy ..... A47C 1/0355 297/85 M
2012/0212018 A1* 8/2012 Ishikawa ..... A47C 1/0352 297/217.1
2012/0286557 A1 11/2012 Hoffman et al.
2013/0175847 A1* 7/2013 Lawson ..... A61G 5/14 297/85 M
2014/0049084 A1* 2/2014 Lawson ..... A47C 1/0355 297/340
2015/0054315 A1* 2/2015 Donovan ..... A47C 1/0242 297/68
2015/0076891 A1* 3/2015 LaPointe ..... A47C 31/008 297/85 M
2015/0272329 A1* 10/2015 Lawson ..... A47C 1/03294 297/342
2015/0282619 A1* 10/2015 Lawson ..... A47C 1/0355 297/83
2016/0022039 A1* 1/2016 Paul ..... A47C 1/0342 297/88
2016/0058195 A1* 3/2016 Huang ..... A47C 1/031 248/398
2016/0106215 A1* 4/2016 Crum ..... A47C 1/03211 297/68
2016/0270537 A1* 9/2016 Marshall ..... A47C 1/0352
2016/0273632 A1* 9/2016 Lawson ..... F16H 25/20

OTHER PUBLICATIONS

International Preliminary Report on Patentability Issued in PCT Application No. PCT/US2015/041563, dated Feb. 2, 2017, 7 Pages.
Extended Search Report dated Dec. 19, 2017 in European Patent Application No. 15824986.2, 6 pages.

* cited by examiner

ZERO-WALL CLEARANCE LINKAGE MECHANISM WITH POWER SEAT DRIVE

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the disclosure relates to an improved linkage mechanism for use on motorized chairs and driven primarily from the seat mounting plate. The improved linkage mechanism accomplishes a zero-wall configuration with fewer parts and a more simplified assembly than existing mechanisms.

Reclining seating units exist that allow a user to extend a footrest forward and to recline a backrest rearward relative to a seat. These existing seating units typically provide three basic positions (e.g., a standard, non-reclined closed position; an extended position (TV position); and a reclined position). In the closed position, the seat resides in a generally horizontal orientation and the backrest is disposed substantially upright. The seating unit includes one or more ottomans that are collapsed or retracted in the closed position, such that the ottomans are not extended. In the extended position, often referred to as a television ("TV") position, the ottomans are extended forward of the seat, and the backrest remains sufficiently upright to permit comfortable television viewing by an occupant of the seating unit. In the reclined position, the backrest is pivoted rearward from the extended position into an obtuse relationship with the seat for lounging or sleeping, while the ottoman remains extended.

Several modern seating units in the industry are adapted to provide the adjustment capability described above. However, these seating units require relatively complex linkage mechanisms to afford this capability. The complex linkage assemblies limit certain design aspects when incorporating automation, as well as adding weight and cost to the mechanism. As such, a more refined linkage mechanism that achieves full movement when being automatically adjusted between the closed, extended, and reclined positions would fill a void in the current field of motion-upholstery technology.

Accordingly, embodiments of the mechanism pertain to a novel, simplified linkage mechanism that efficiently moves a seating unit among the various positions, driven primarily using the seat mounting plate. The linkage mechanism is constructed in a simple and refined arrangement in order to provide suitable function while overcoming the above-described, undesirable features inherent within the conventional complex linkage mechanisms.

BRIEF SUMMARY OF THE INVENTION

Embodiments seek to provide a simplified linkage mechanism that can be assembled to a motor and that can be adapted to essentially any type of seating unit. In an exemplary embodiment, the compact motor in concert with the linkage mechanism can achieve full movement of the seating unit between the closed, extended, and reclined positions. The motor may be employed in an efficient and cost-effective manner to adjust the linkage mechanism and is coupled primarily to the seat mounting plate.

Generally, the seating unit includes the following components: at least a first foot-support ottoman; a pair of floor rails in substantially parallel-spaced relation; a pair of seat mounting plates in substantially parallel-spaced relation, a seating support surface extending between the seat mounting plates; and a pair of generally mirror-image linkage mechanisms that interconnect the floor rails to the seat mounting plates. In operation, the linkage mechanisms are adapted to move the seating unit between a closed position, an extended position, and a reclined position. The linkage mechanisms are coupled to a motor or linear actuator assembly primarily through a coupling directly to the seat mounting plate. This connection to the seat mounting plate is much more direct than in previous seating units and allows elimination of parts and connections in comparison to previous seating units.

BRIEF DESCRIPTION OF THE SEVERAL VIEWS OF THE DRAWINGS

In the accompanying drawings which form a part of the specification and which are to be read in conjunction therewith, and in which like reference numerals are used to indicate like parts in the various views.

DETAILED DESCRIPTION OF THE INVENTION

Figure 19:
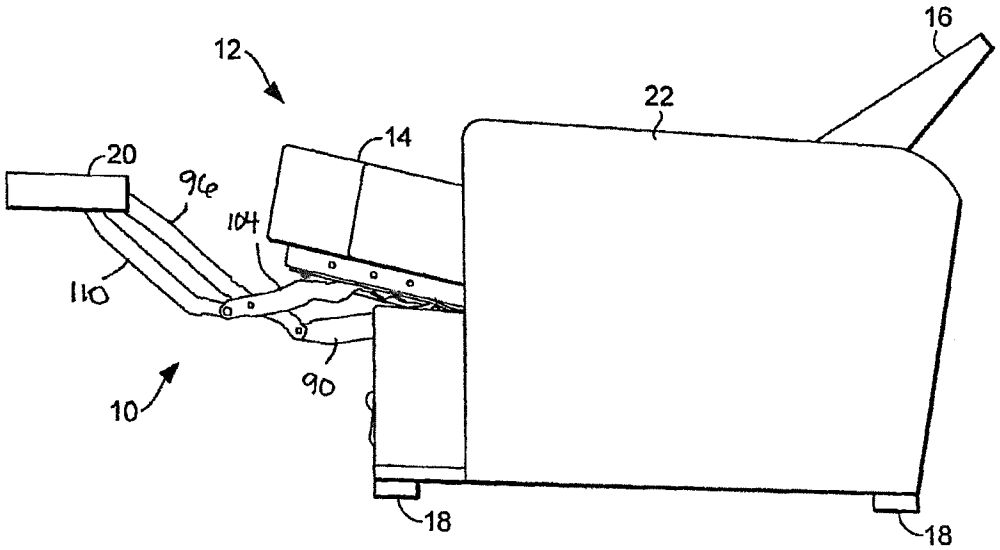
FIG. 19 is a diagrammatic view of a seating unit using the mechanism of FIGS. 1-18.

FIGS. 1-9 illustrate a first embodiment of a mechanism 10 for use on a motion seating unit 12, as shown in FIG. 19.

Seating unit 12 has a seat 14, a backrest 16, legs 18, an ottoman 20, and a pair of opposed arms 22. The mechanism 10 couples the seat 14, the backrest 16, and the ottoman 20 together to move the seating unit 12 between closed, TV, and fully reclined positions, as is more fully described below.

Figure 1:
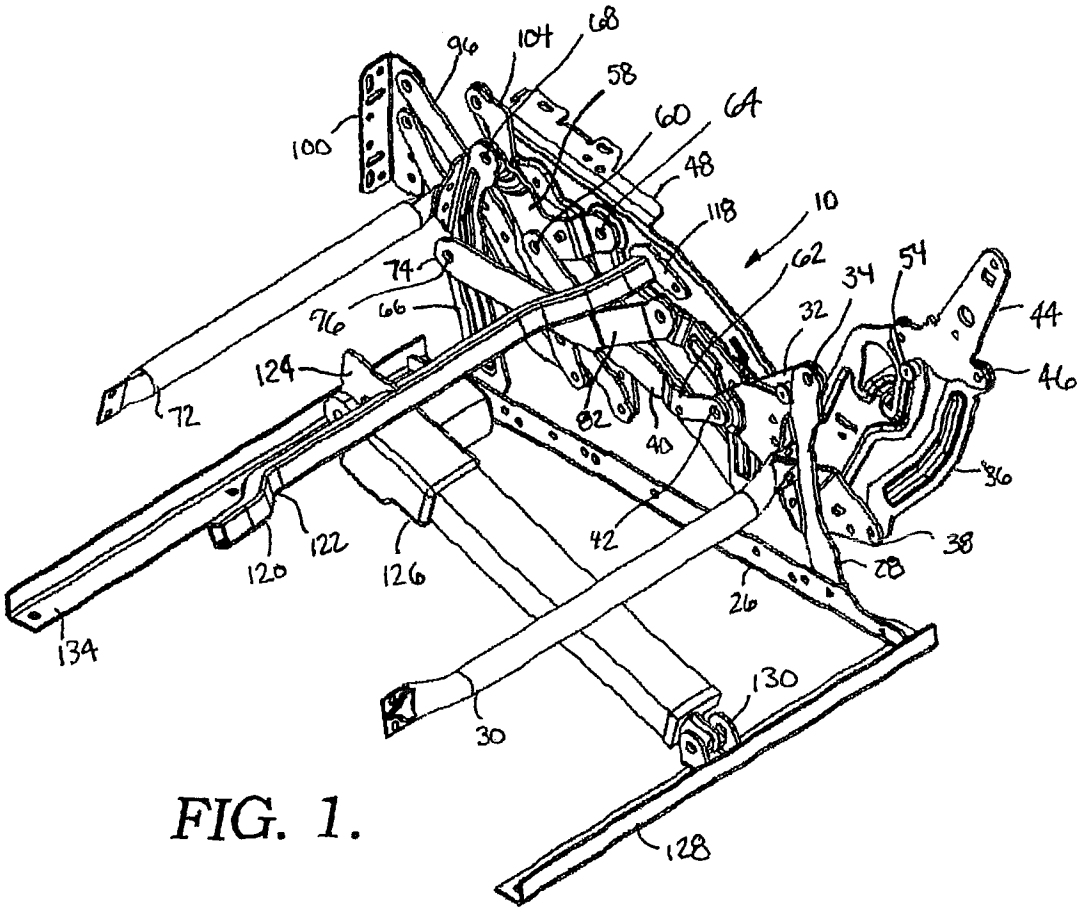
FIG. 1 is a perspective view of a mechanism for a seating unit in a closed position, with one side removed for clarity.
Figure 3:
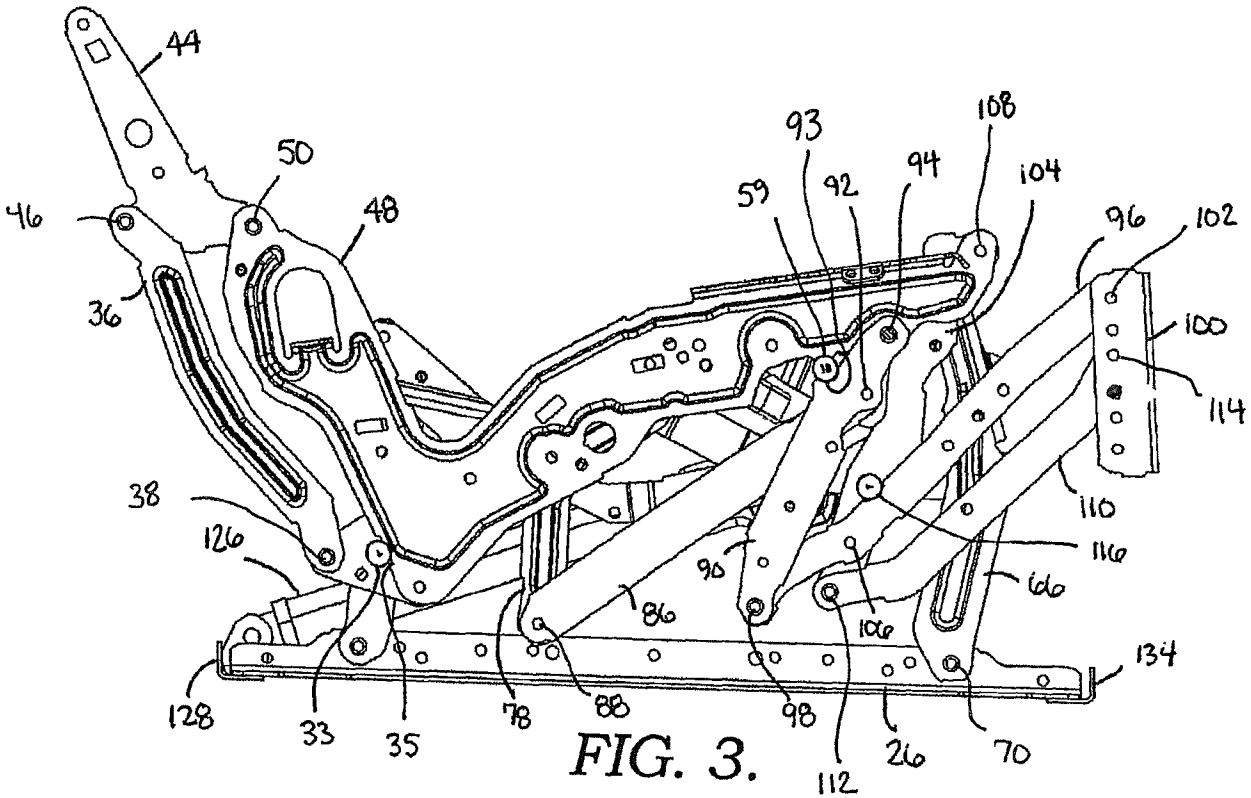
FIG. 3 is a side view similar to FIG. 2, from the opposite side.
Figure 4:
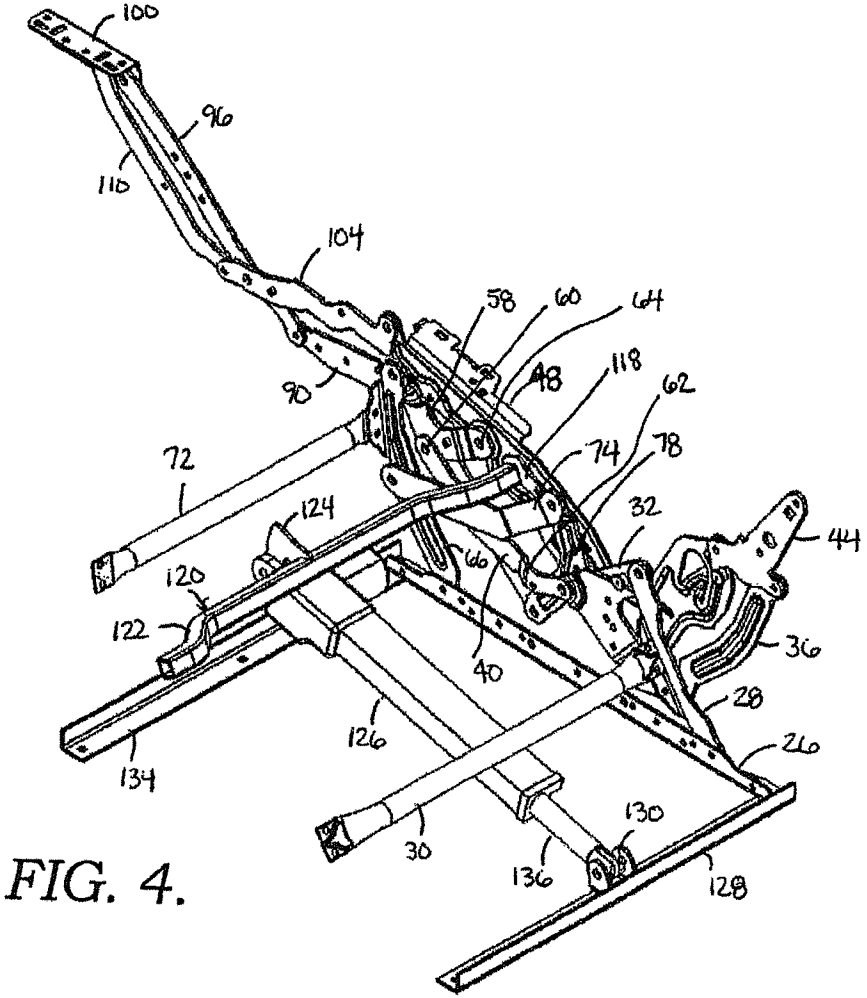
FIG. 4 is a perspective view of a mechanism, similar to FIG. 1, but in the TV position.
Figure 6:
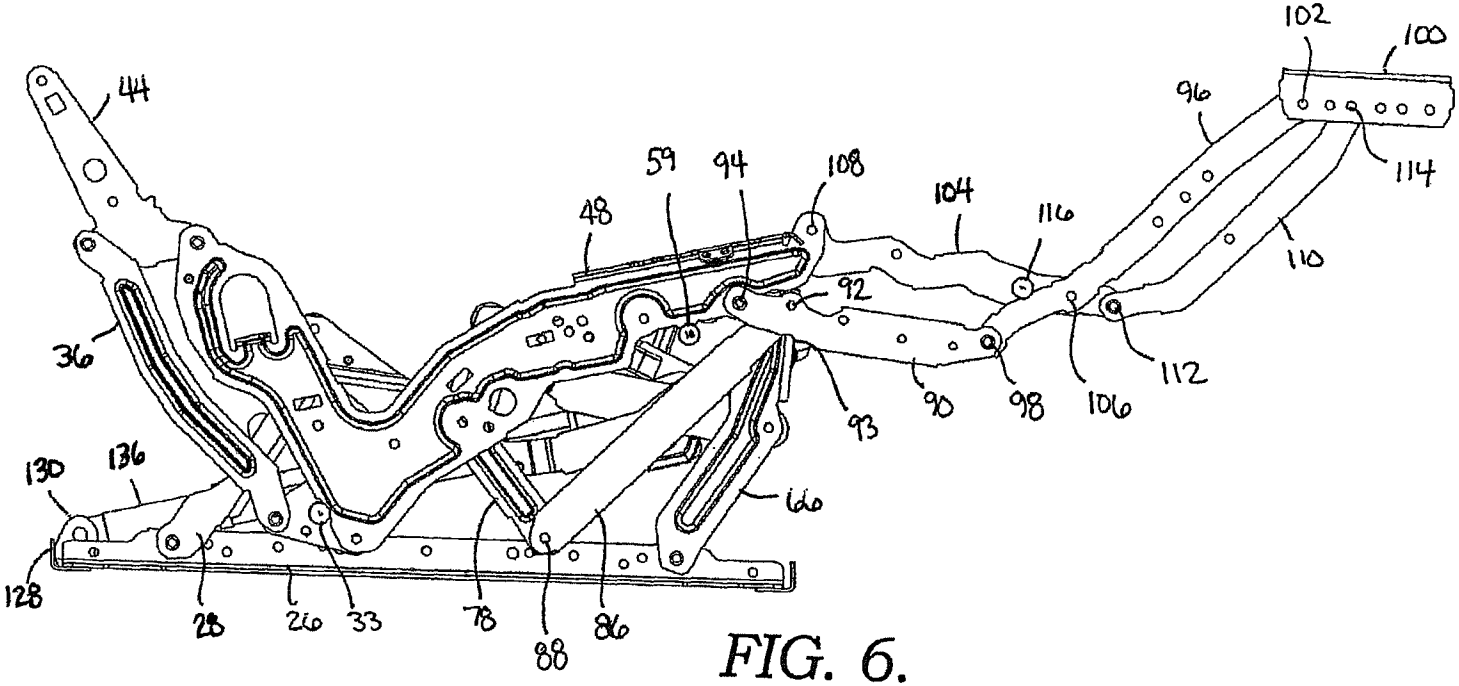
FIG. 6 is a side view similar to FIG. 5, from the opposite side.
Figure 7:
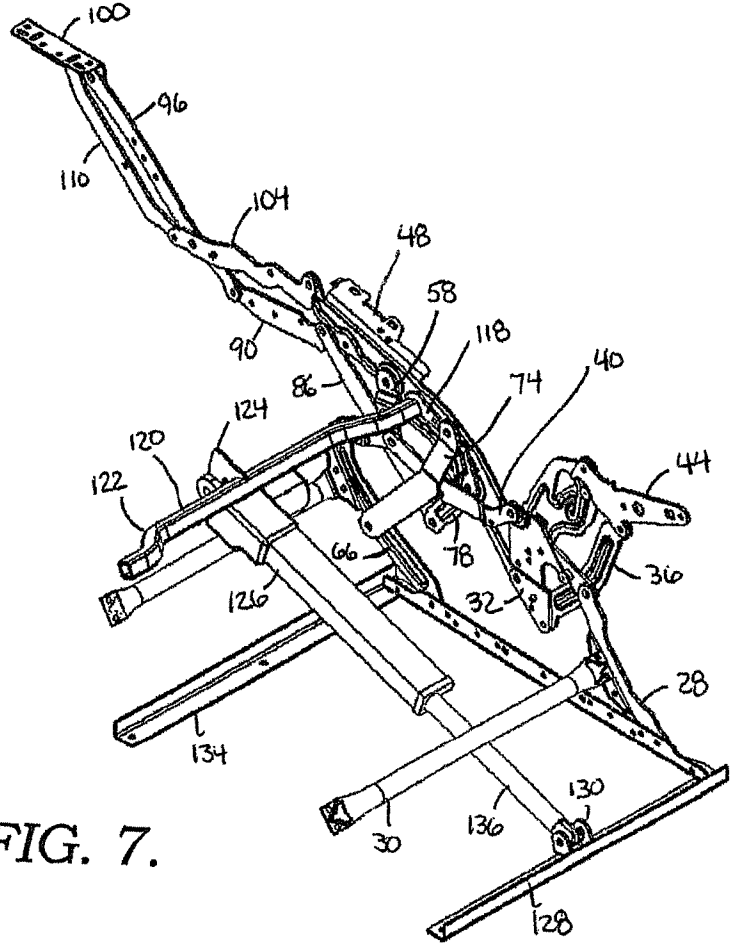
FIG. 7 is a perspective view of a mechanism, similar to FIG. 1, but in the fully reclined position.
Figure 8:
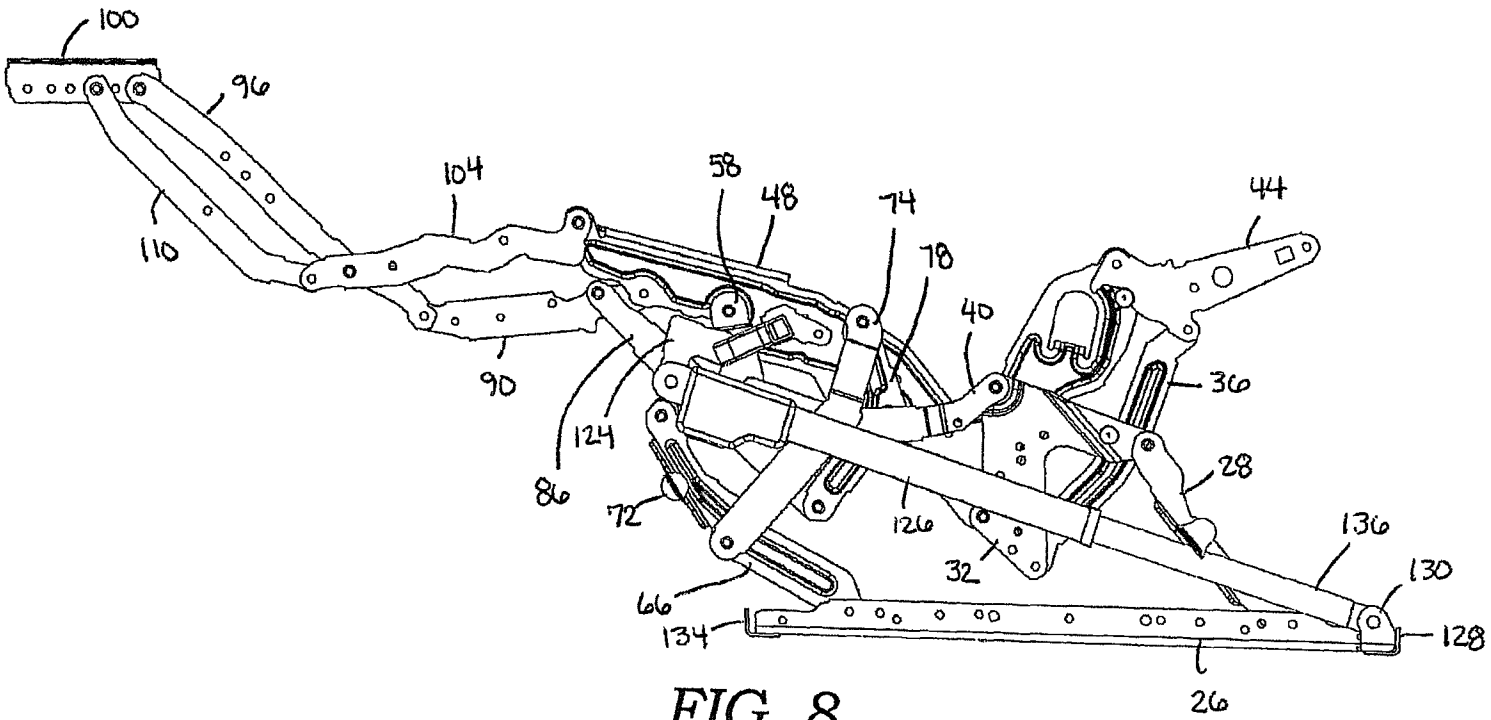
FIG. 8 is a side view of the mechanism of FIG. 7.

As shown in FIGS. 1, 4, and 7, mechanism 10 is adjustable to three basic positions: a closed position (FIG. 1), an extended position (i.e., TV position) (FIG. 4), and a reclined position (FIG. 7). Additionally, only one side of mechanism 10 is shown, with the other side being a mirror-image of the side shown and described. FIG. 1 depicts the mechanism 10 adjusted to the closed position, which is a normal, non-reclined sitting position with the seat 14 in a generally horizontal position and the backrest 16 generally upright and in a substantially perpendicular position relative to the seat 14. Note that FIGS. 1-18 show the mechanism 10 with the outer parts of the seating unit 12 removed for clarity. In particular, the seat 14 is disposed in a slightly inclined orientation relative to the floor. When adjusted to the closed position, the ottoman 20 is retracted and is positioned below the seat 14. FIG. 4 depicts the extended, or TV, position. When the mechanism 10 is adjusted to the extended position, the ottoman 20 is extended forward so it is generally horizontal. However, the backrest 16 remains substantially perpendicular to the seat. Also, the seat 14 is maintained in generally the same orientation relative to the floor. Typically, the seat 14 is translated slightly forward and upward. FIG. 7 depicts the fully reclined position. The backrest 16 is rotated rearward by the linkage mechanism 10. However, the rearward movement of the backrest 16 is offset by a forward and upward translation of the seat 14 as controlled by the linkage mechanism 10. The forward and upward translation of the seat 14 in embodiments of the present invention allows for "zero-wall" clearance. Generally, the "zero-wall" clearance is used herein to refer to space-saving utility that permits positioning the seating unit 12 in close proximity to an adjacent rear wall and other fixed objects.

As described below, the linkage mechanism 10 comprises a plurality of other linkages that are arranged to actuate and control movement of the seating unit 12 during movement between the closed, extended, and reclined positions. These linkages may be pivotally interconnected. The pivotal couplings (illustrated as pivot points in the figures) between these linkages can take a variety of configurations, such as pivot pins, bearings, traditional mounting hardware, rivets, bolt and nut combinations, or any other suitable fasteners, which are well known in the furniture-manufacturing industry. Further, the shapes of the linkages and the brackets may vary, as may the locations of certain pivot points. It will be understood that when a linkage is referred to as being pivotally "coupled" to, "interconnected" with, "attached" on, etc., another element (e.g., linkage, bracket, frame, and the like), it is contemplated that the linkage and elements may be in direct contact with each other or other elements, such as intervening elements, which may also be present. Not all reference numerals are listed on all figures, for clarity, but the same parts numbered in one figure correspond to similar parts numbered in other figures.

Generally, the linkage mechanism 10 guides the coordinated movement of the backrest, the seat, and the ottoman. In an exemplary configuration, these movements are controlled by a pair of essentially mirror-image linkage mechanisms (one of which is shown herein and indicated by reference numeral 10), which comprise an arrangement of pivotal interconnected linkages. The linkage mechanisms are disposed in opposing-facing relation about a longitudinally extending plane that bisects the recliner between the pair of opposed arms. As such, the ensuing discussion will focus on only one of the linkage mechanisms 10, with the content being equally applied to the other complimentary linkage assembly.

Figure 2:
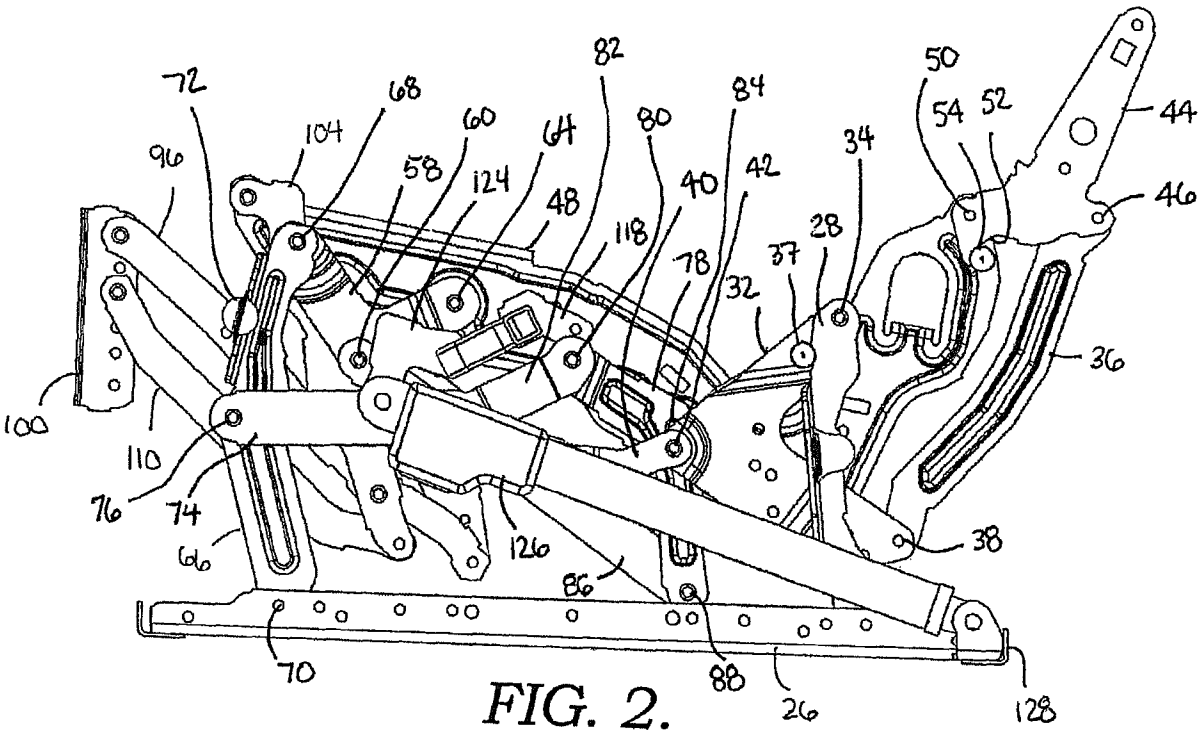
FIG. 2 is a side view of the mechanism of FIG. 1.
Figure 5:
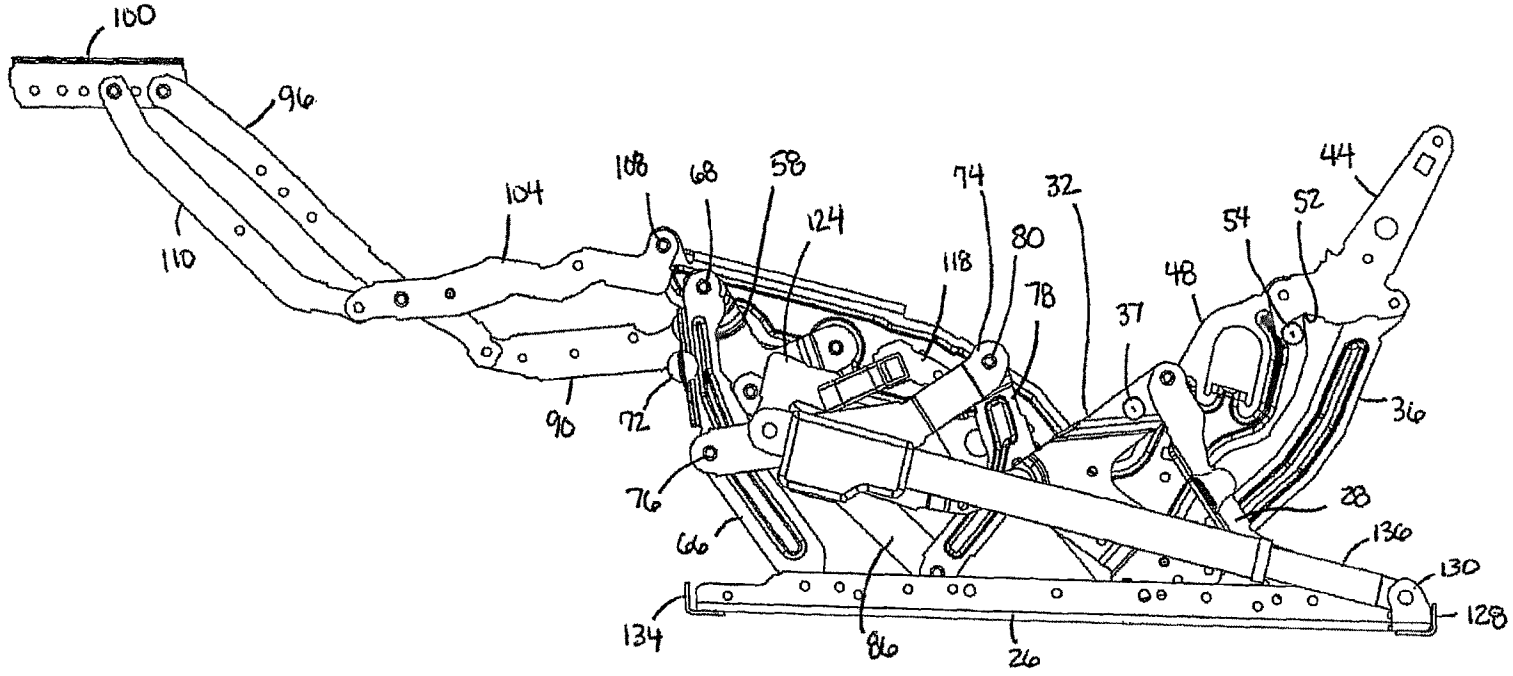
FIG. 5 is a side view of the mechanism of FIG. 4.

FIGS. 1-9 illustrate the configuration of linkage mechanism 10 in a first aspect, for a motorized, zero-wall clearance, seating unit 12. Mechanism 10 has a pair of parallel, spaced sides, one left and one right, although only one side is shown in the figures for clarity. Each side of mechanism 10 includes a side rail 26 that extends from the front of the seating unit 12 to the back. Rails 26 are used to mount the mechanism 10 to the base of the seating unit 12 and operate as the base of the mechanism 10. A rear pivot link 28 extends upwardly from the rail 26 and is pivotally connected to the rail 26 at a lower end thereof. Unless otherwise described differently, each of the rails, links, and brackets described herein are typically made of formed or stamped steel, but other materials with similar characteristics could be used. Rear pivot link 28 has an outward extension formed generally between its ends that functions to couple a rear cross tube 30 between the left and right mechanisms 10. Rear cross tube 30 provides stability to the mechanism 10. The upper end of rear pivot link 28 is pivotally coupled to a rear bell crank 32 at pivot 34. Rear bell crank 32 is also pivotally coupled to a rear control link 36 at pivot 38. Finally, rear bell crank 32 is pivotally coupled to a bridge link 40 at pivot 42. As can be seen, rear bell crank 32 is somewhat triangularly shaped and connects the rear pivot link 28, the rear control link 36, and the bridge link 40. As best seen in FIG. 3, a stop pin 33 is rigidly secured to rear bell crank 32 that operates to keep a seat mounting plate 48 (described below) in position as stop pin 33 moves along a notch 35 formed in seat mounting plate 48. As best seen in FIGS. 2 and 5, rear bell crank 32 has another stop pin 37 that contacts rear pivot link 28 when the mechanism is in a closed position.

The rear control link 36 is coupled on one end to the rear bell crank 32 at pivot 38. It extends upwardly and rearwardly, and is pivotally connected to a back mounting link 44 at its other end, at pivot 46. Rear control link 36 is thus pivotally connected between rear bell crank 32 and back mounting link 44. Back mounting link 44 has a forward end that is pivotally coupled to a seat mounting plate 48 at pivot 50. As best seen in FIG. 2, near pivot 50, back mounting link 44 has a lower cam surface 52 that contacts a stop, or cam, 54 that is rigidly coupled to seat mounting plate 48. The upper end of back mounting link 44 is used to couple the backrest 16 of seating unit 12 to the mechanism 10. As back mounting link 44 pivots rearwardly, the backrest 16 is reclined.

Figure 9:
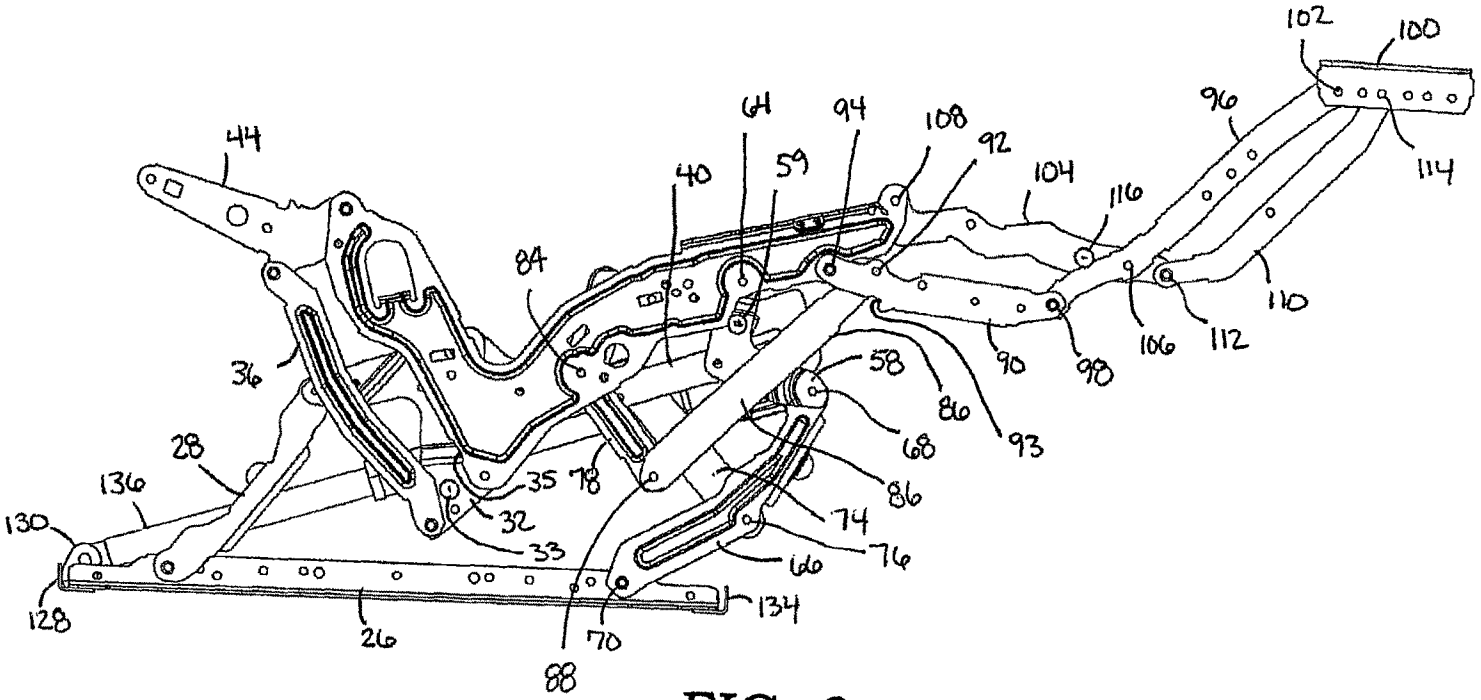
FIG. 9 is a side view similar to FIG. 8, from the opposite side.
Figure 10:
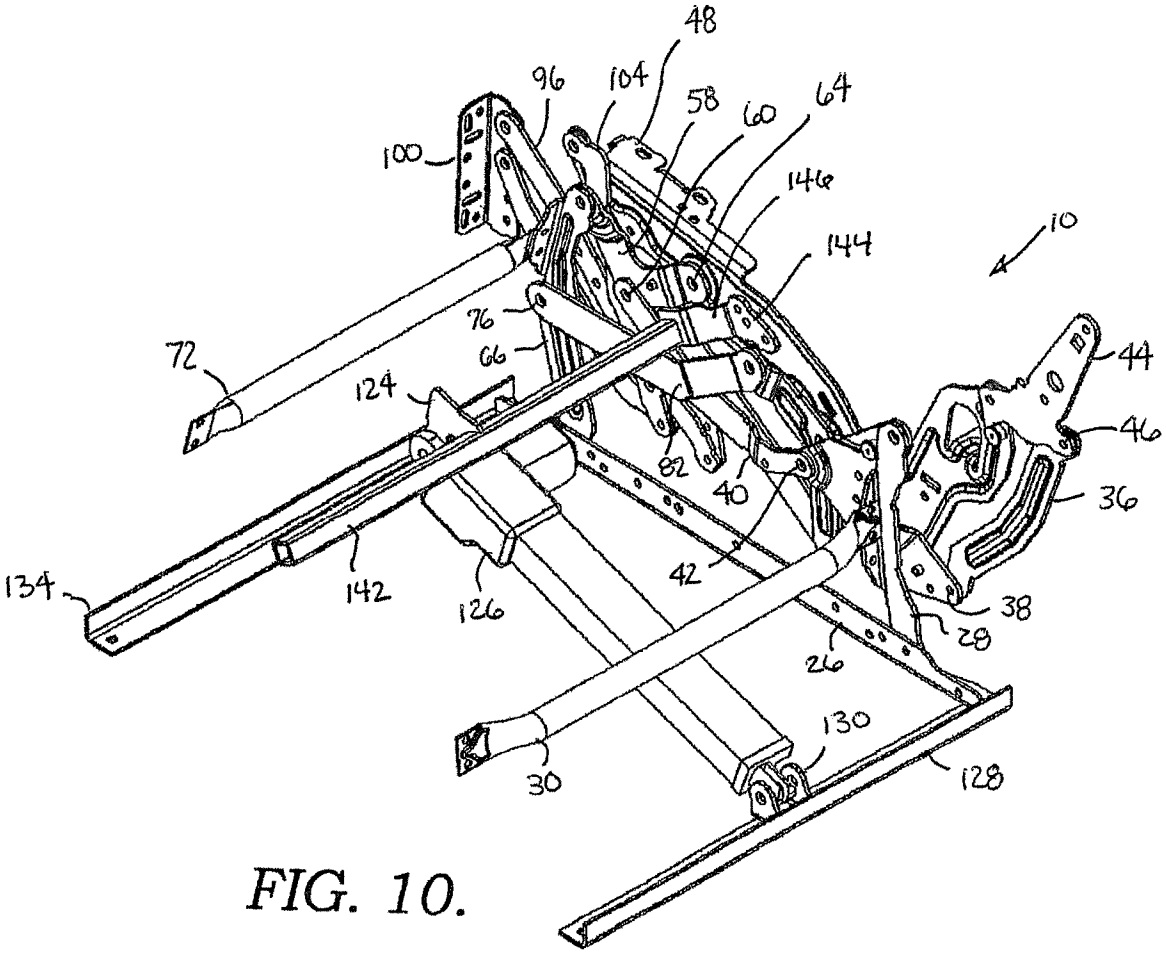
FIG. 10 is a perspective view of a mechanism for a seating unit in a closed position, with one side removed for clarity, similar to FIG. 1, but with a different drive tube assembly.
Figure 11:
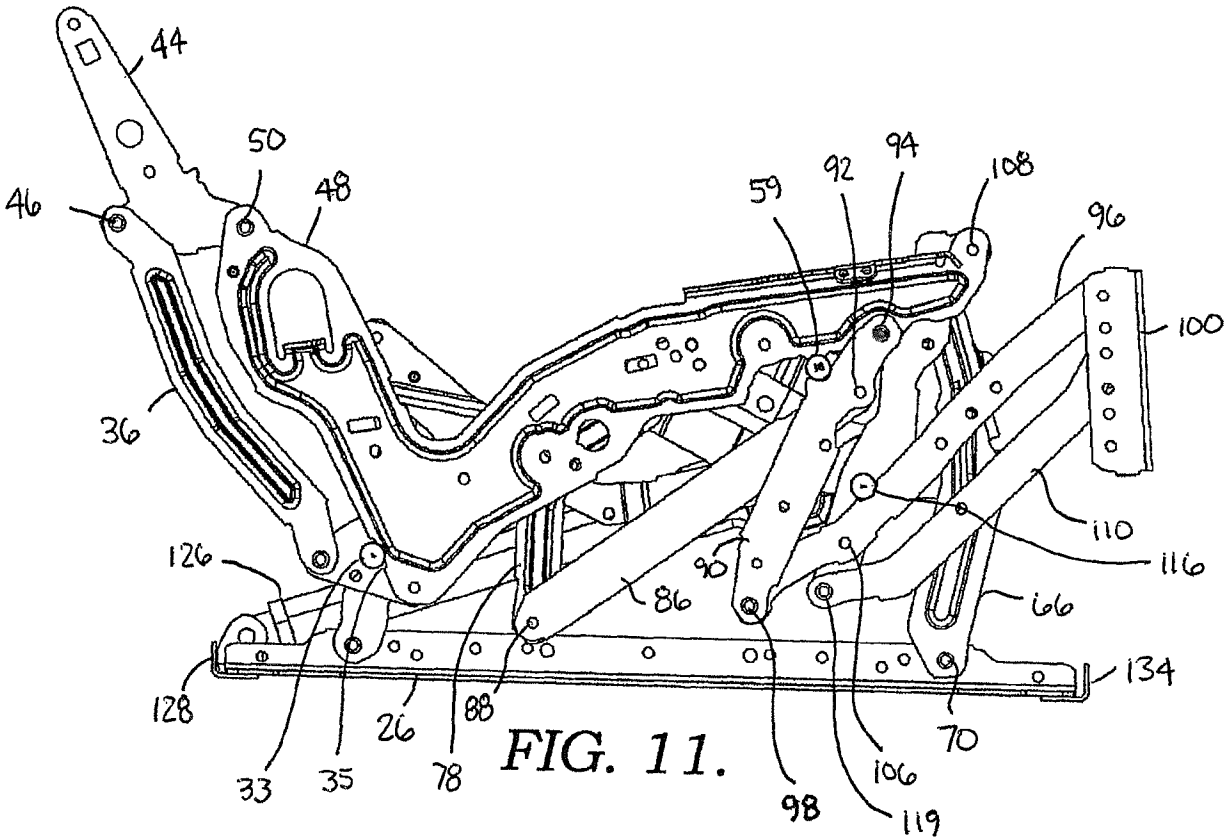
FIG. 11 is a side view of the mechanism of FIG. 10.
Figure 12:
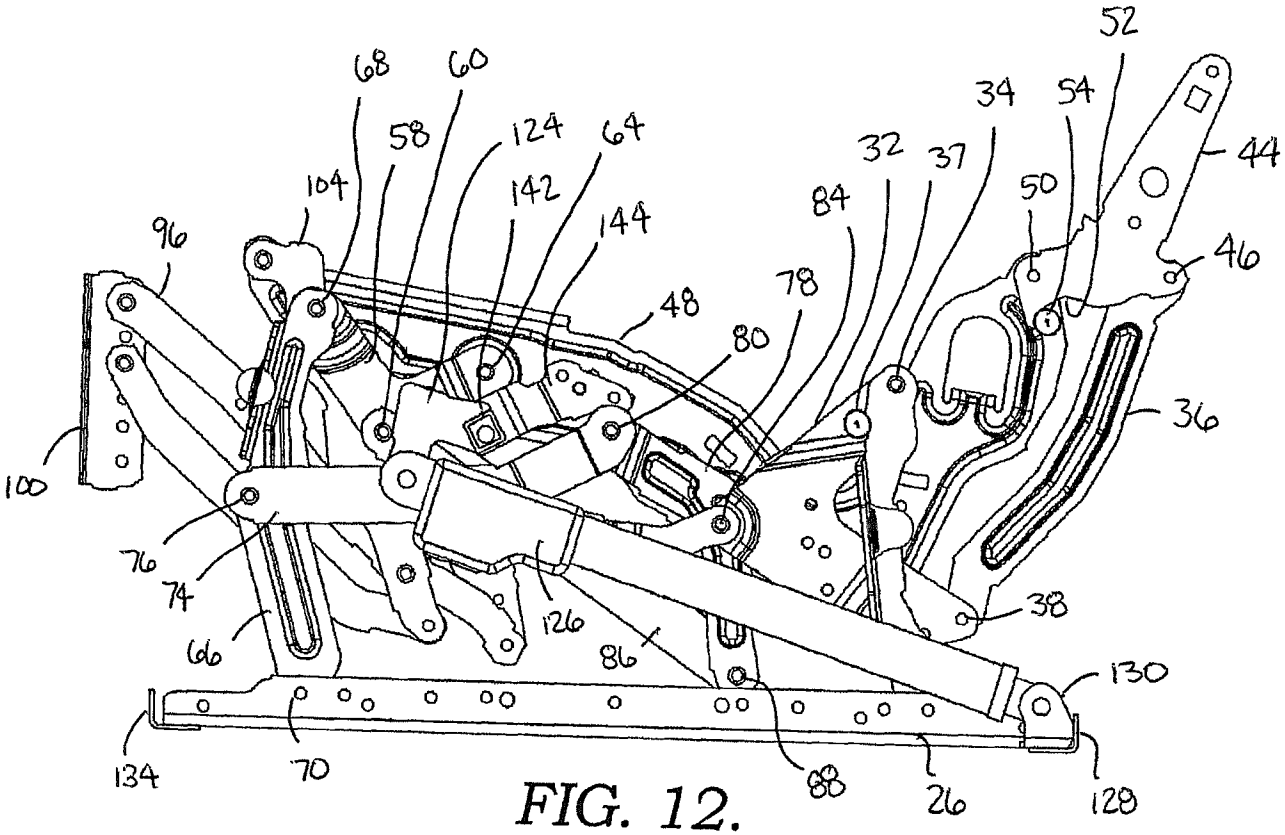
FIG. 12 is a side view similar to FIG. 11, from the opposite side.
Figure 13:
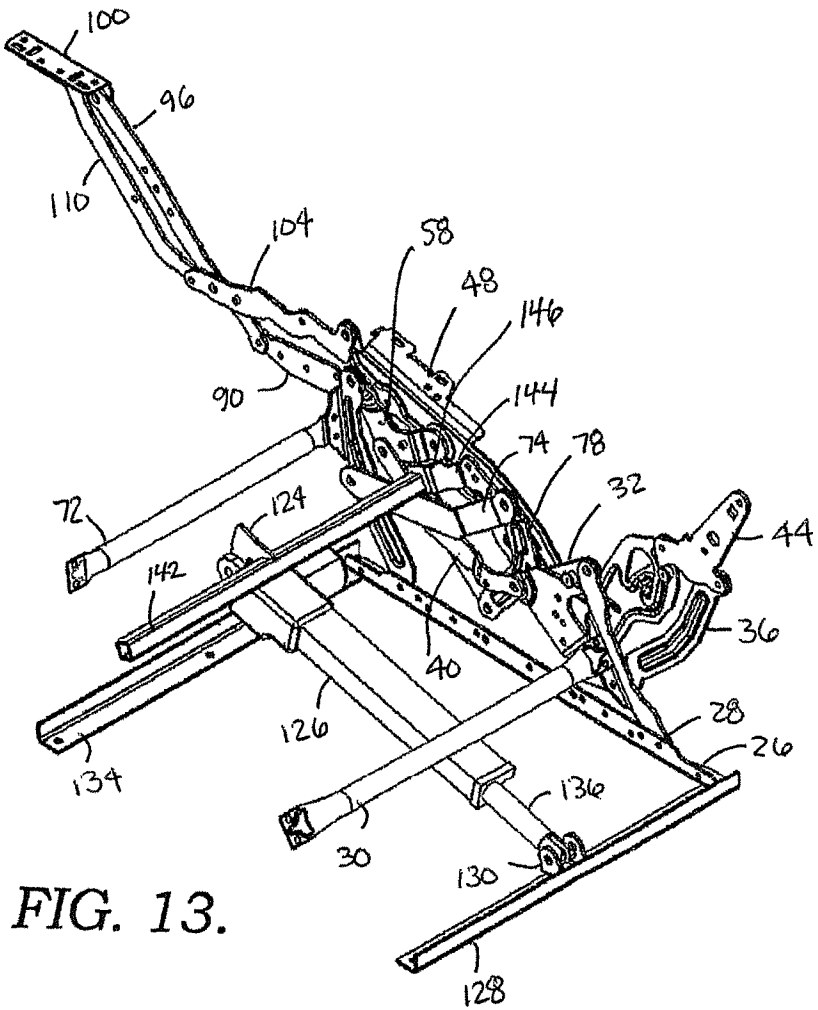
FIG. 13 is a perspective view of a mechanism, similar to FIG. 10, but in the TV position.
Figure 14:
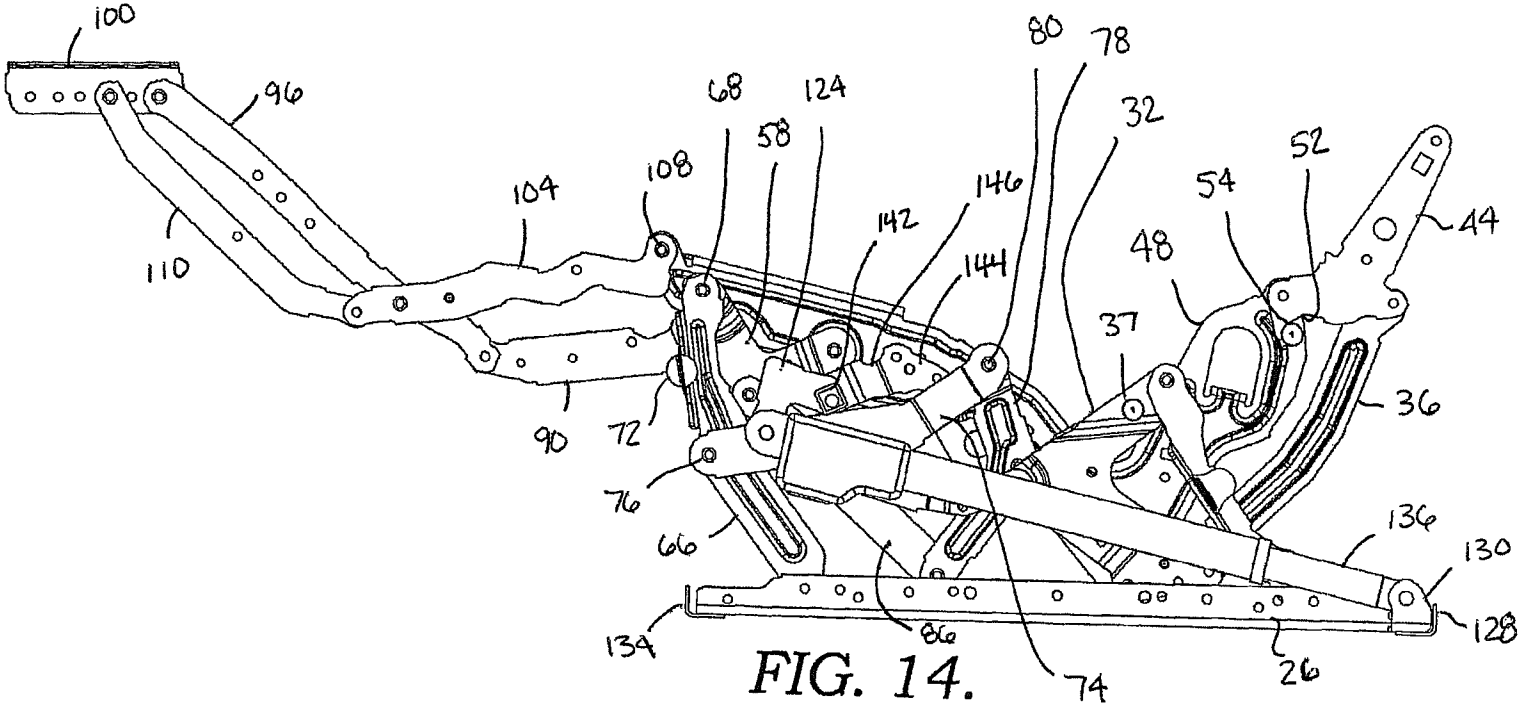
FIG. 14 is a side view of the mechanism of FIG. 13.
Figure 15:
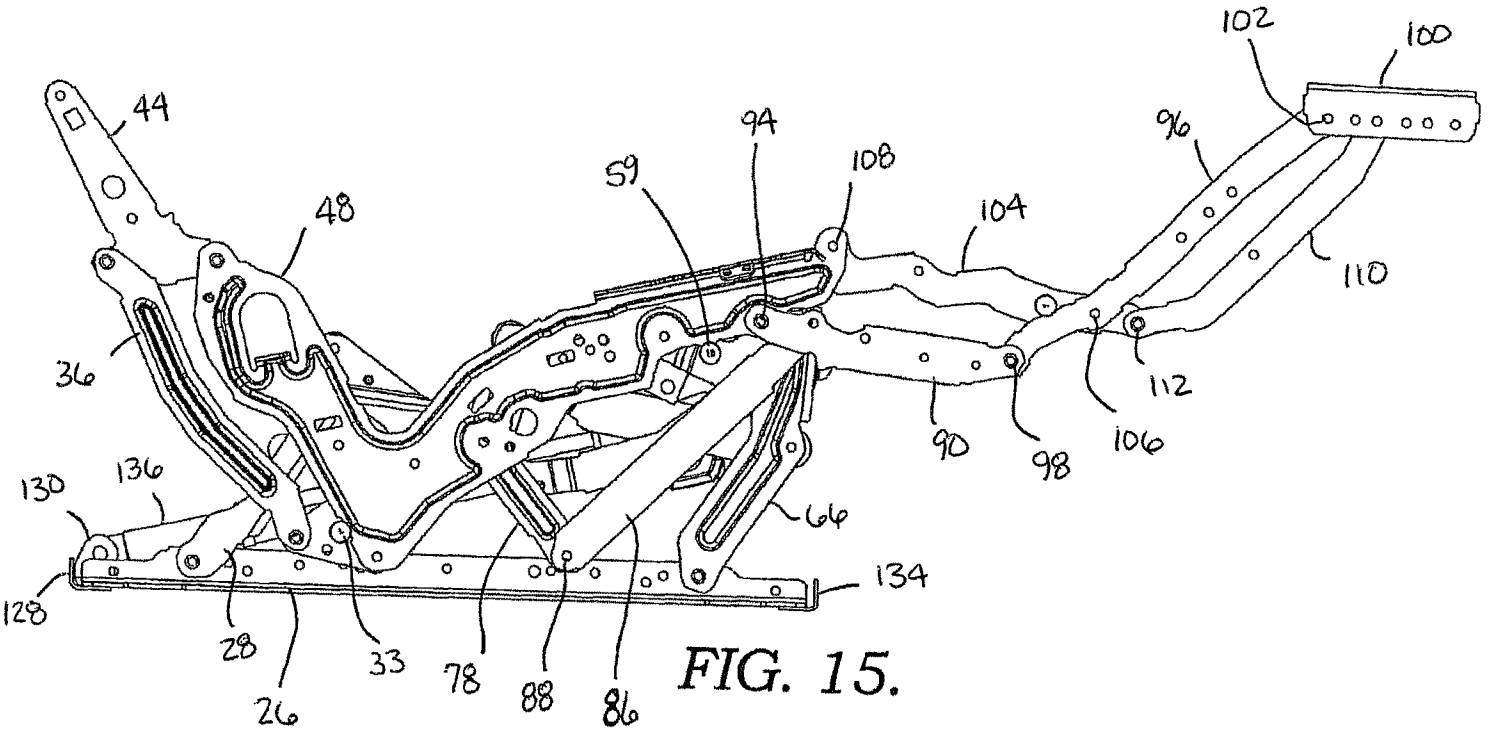
FIG. 15 is a side view similar to FIG. 14, from the opposite side.
Figure 16:
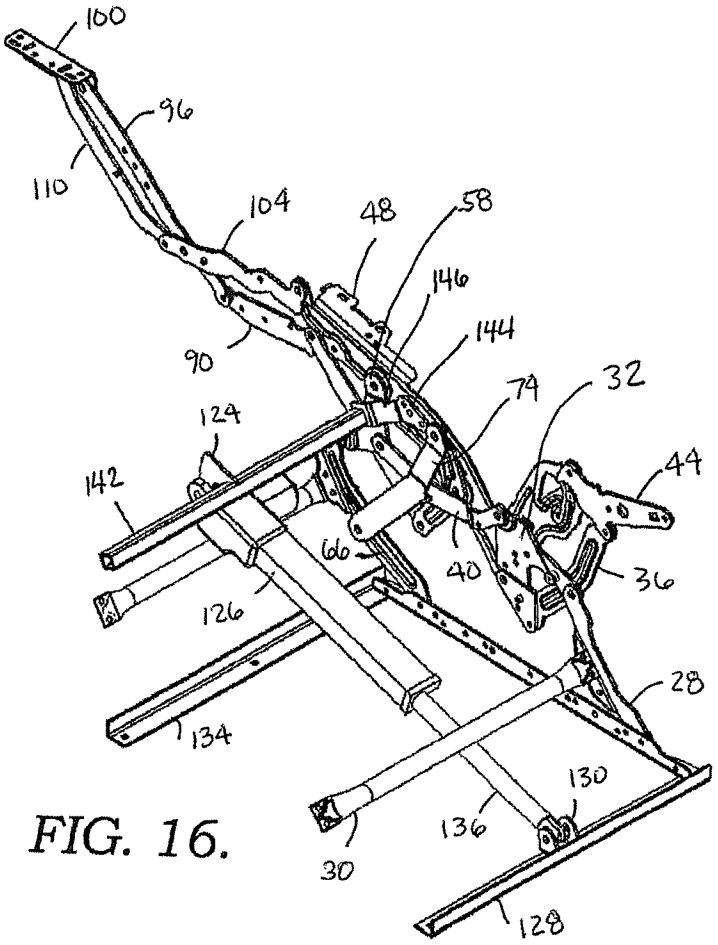
FIG. 16 is a perspective view of a mechanism, similar to FIG. 10, but in the fully reclined position.
Figure 17:
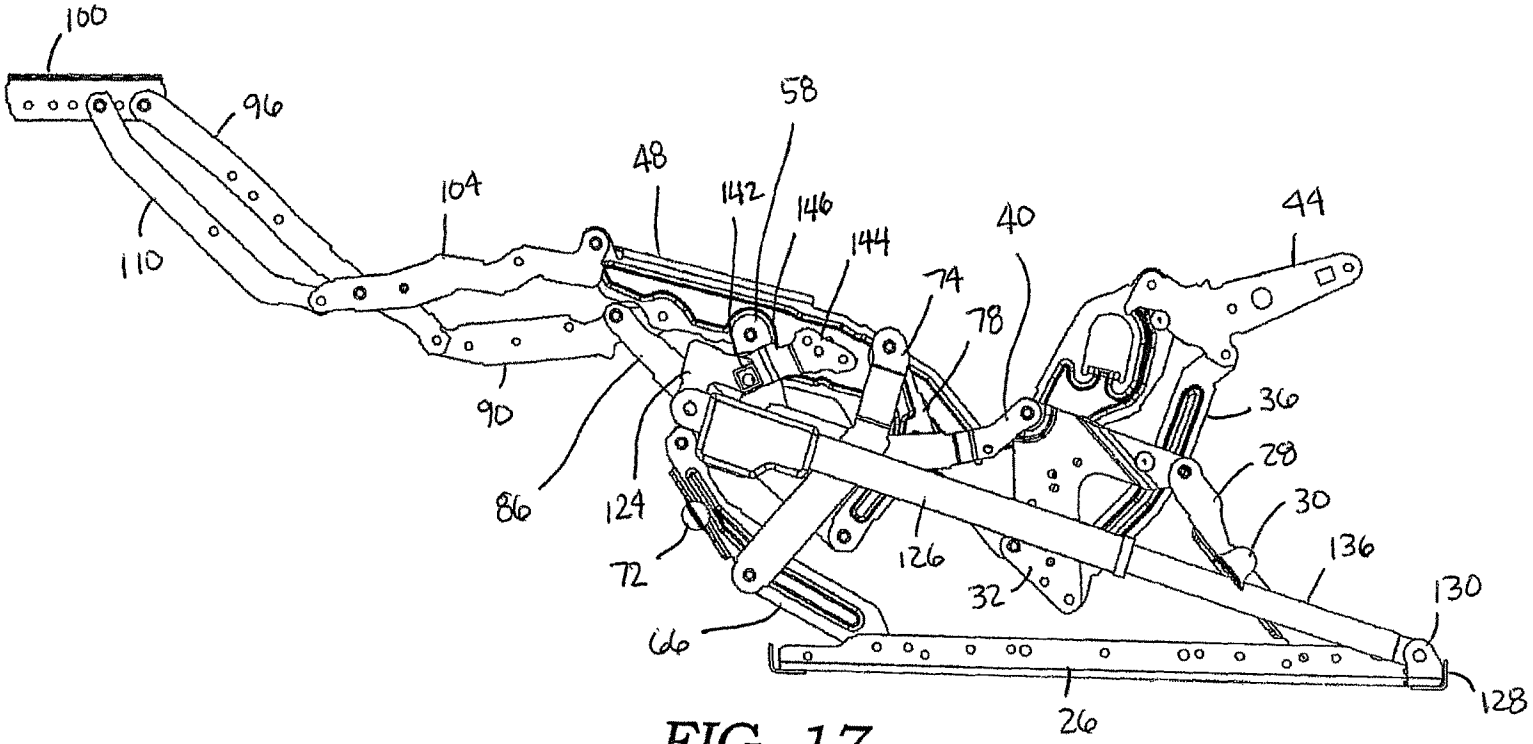
FIG. 17 is a side view of the mechanism of FIG. 16.
Figure 18:
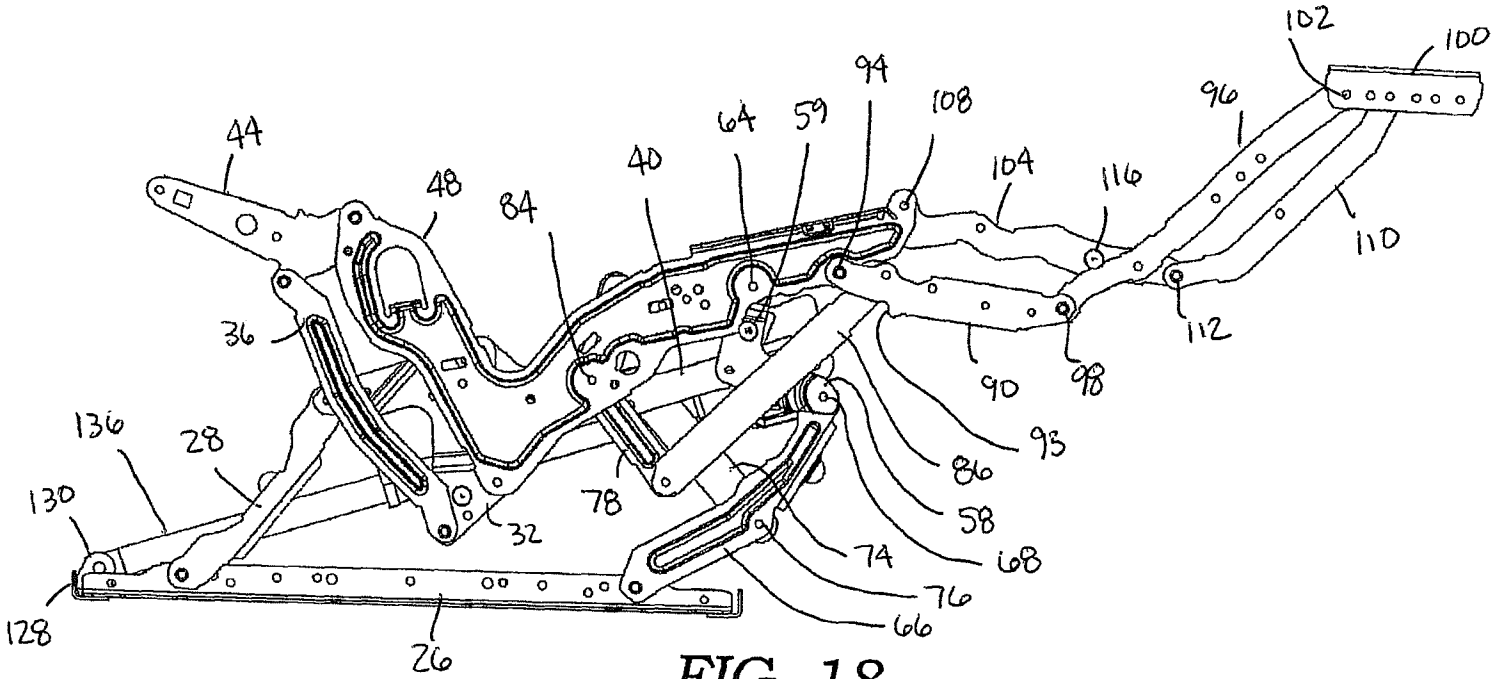
FIG. 18 is a side view similar to FIG. 17, from the opposite side.

Returning to bridge link 40, it can be seen that one end of bridge link 40 is pivotally coupled to rear bell crank 32 at pivot 42. The opposite, forward end of bridge link 40 is pivotally coupled to an L-shaped, front lift link 58 at pivot 60. As best seen in FIG. 4, bridge link 40 has an outward bend section 62 to provide clearance for other links of mechanism 10 to move properly and freely. The outer end of one leg of front lift link 58 is pivotally coupled to seat mounting plate 48 at pivot 64. The outer end of the other leg of front lift link 58 is pivotally coupled to a front pivot link 66 at pivot 68. Front lift link 58 is thus pivotally connected to bridge link 40, seat mounting plate 48, and front pivot link 66. As best seen in FIGS. 3, 6, and 9, front lift link 58 has a stop pin 59 rigidly secured thereto and extending therefrom, the importance of which is detailed below.

Front pivot link 66 is thus coupled on one end to the front lift link 58 and is pivotally coupled on the opposite, lower end to side rail 26 at pivot 70. A front cross tube 72 extends between the pair of front pivot links 66 and couples them together, generally adjacent the upper end of each front pivot link 66. Like rear cross tube 30, front cross tube 72 provides stability to the mechanism 10, connecting the two sides together. A carrier link 74 is pivotally coupled to front pivot link 66 at pivot 76 generally midway between pivots 68 and 70. Carrier link 74 extends rearwardly from pivot 76 and is coupled on its other end to a front bell crank 78 at pivot 80. As with bridge link 40, carrier link 74 has a bend section 82 to provide clearance for the other links of mechanism 10.

Front bell crank 78 has a somewhat boomerang shape, as shown. One end of front bell crank 78 is pivotally coupled to carrier link 74. Generally, at the midpoint, front bell crank 78 is pivotally coupled to seat mounting plate 48 at pivot 84. The opposite end of front bell crank 78 is pivotally coupled to ottoman drive link 86 at pivot 88. As best seen in FIG. 3, the end of ottoman drive link 86 opposite pivot 88 is pivotally coupled to rear ottoman link 90 at pivot 92. Rear ottoman link 90 is pivotally coupled at its top end to seat mounting plate 48 at pivot 94. The lower end of rear ottoman link 90 is pivotally coupled to a top ottoman link 96 at pivot 98. Rear ottoman link 90 has a notch 93 to accommodate stop pin 59 when the linkage is in a closed position. The top ottoman link 96 is part of the ottoman linkage and is pivotally coupled at its opposite end to an ottoman bracket 100 at pivot 102. Ottoman bracket 100 is connected to and supports ottoman 20. Near pivot 98, top ottoman link 96 is pivotally coupled to a front ottoman link 104 at pivot 106. One end of front ottoman link 104 is pivotally coupled to seat mounting plate 48 at pivot 108. The other end of front ottoman link 104 is pivotally coupled to a lower ottoman link 110 at pivot 112. Opposite pivot 112, lower ottoman link 110 is pivotally coupled to ottoman bracket 100 at pivot 114. As best seen in FIG. 6, front ottoman link 104 has a stop pin 116 rigidly secured near pivot 106. Stop pin 116 stops the extension of the ottoman linkage at the desired location.

Returning to seat mounting plate 48, a drive tube mounting bracket 118 is rigidly secured generally about the midpoint of seat mounting plate 48. As best seen in FIG. 1, drive tube mounting bracket 118 is used to secure a drive tube 120 between both seat mounting plates 48. As seen in FIG. 1, drive tube 120 has a slight forward bend 122. A connector link 124 is rigidly secured to drive tube 120 at its midpoint. The connector link 124 is used to pivotally couple the drive tube 120 to a motor 126. Motor 126 extends between the drive tube 120 and a rear cross rail 128 that extends between the two side rails 26. To facilitate that connection, a clevis 130 is formed or secured to rear cross rail 128. A front cross rail 134 similarly extends between the two side rails 26 to connect the two sides of mechanism 10 together. The motor can be operated to extend a motor shaft 136. Extension of the shaft 136 operates to move the linkage between the closed, TV, and fully reclined positions.

More specifically, in operation, the motor 126 can be activated to extend shaft 136 when the mechanism 10 is in the closed position of FIG. 1. Extension of the shaft 136 operates to move the drive tube 120 in a forward direction. Due to the connection to seat mounting plate 48, the movement of drive tube 120 moves seat mounting plate 48 in a forward direction as well. As can be seen in FIGS. 3 and 6, movement of seat mounting plate 48 causes a rotation of front bell crank 78 about pivot 84, which in turn causes the pivotal connection between front bell crank 78 and ottoman drive link 86 to move forwardly. This movement drives ottoman drive link 86, which in turn drives (as viewed from the perspective of FIGS. 3 and 6) a counterclockwise rotation of rear ottoman link 90 about pivot 94. As rear ottoman link 90 rotates, the ottoman bracket 100 is moved to the extended position shown in FIG. 6 by the interconnection of links 90, 96, 104, and 110. The stop pin 116 prevents over extension of the ottoman linkage.

As the seat mounting plate 48 moves forward, the seat translates forwardly, and downward, as rear pivot link 28 and front pivot link 66 rotate about their respective connections to side rail 26. In this TV position, the back mounting link 44 remains in substantially the same orientation so that the back 16 remains substantially upright.

Further activation of motor 126 causes additional forward force on seat mounting plate 48, acting through drive tube 120. The stop pin 116 prevents further extension of the ottoman linkage. As the seat mounting plate 48 is urged forwardly, front lift link 58 rotates and acts to lift seat mounting plate 48. This further movement also causes a rotation of rear bell crank 32, which pulls rear control link 36 forward and downward. As rear control link 36 rotates and moves, it causes back mounting link 44 to rotate about pivot 50, thus acting to recline the back 16. Because the seat mounting plate 48 moves forwardly as the mechanism 10 moves to the fully reclined position, the mechanism 10 affords a zero-wall clearance for the seating unit 12. The direct connection of motor 126 to seat mounting plate 48 through mounting bracket 118 and drive tube 120 allows a more simplified motorized mechanism as compared to previous offerings. This simplification reduces the weight of the mechanism through removal of now unneeded parts, as well as reducing cost.

FIGS. 10-18 illustrate an alternative mechanism 10 that is largely the same as that described above with respect to FIGS. 1-9. Mechanism 10 of FIGS. 10-18 utilizes a different drive tube 142 and drive tube bracket 144. As shown, drive tube 142 is a straight tube, as opposed to the bent drive tube 120 of FIGS. 1-9. Drive tube bracket 144 is fixedly coupled to seat mounting plate 48, and includes a forward offset section 146 to properly position drive tube 142 and to allow connection of drive tube 142 to seat mounting plate 48. The remainder of the links and connections remain the same, as does the movement of the mechanism 10, and so the description is not repeated here. The links and connections are consistently numbered, with the exception of the drive tube 142 and drive tube bracket 144 (with offset section 146 as well). The alternative mechanism of FIGS. 10-18 thus similarly drives the seating unit through a direct, fixed connection between the drive tube 142 and the seat mounting plate 48.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A mechanism providing powered recline and footrest extension for a seating unit, the mechanism comprising:

a base;

a pair of spaced, opposed seat mounting plates spaced apart from the base;

a pair of linkage mechanisms that moveably interconnect the base and the seat mounting plates, the linkage mechanisms configured to move the seating unit between closed, TV and fully reclined positions;

a drive tube spanning the space between the seat mounting plates; and a linear actuator having a first portion and an extension rod configured to extend from the first portion, the first portion coupled to the drive tube and the extension rod coupled to the base, wherein, from the closed position, extension of the linear actuator causes forward movement of the drive tube, and wherein forward movement of the drive tube causes forward movement of the seat mounting plates, resulting in movement of the seating unit from a closed position to a TV position, and further extension of the linear actuator results in movement from the TV position to the fully reclined position.

2. The mechanism of claim 1, wherein the drive tube has a pair of opposed ends, and wherein each opposed end is rigidly coupled to a respective seat mounting plate.

3. The mechanism of claim 2, further comprising a pair of drive tube mounting brackets rigidly secured between each drive tube opposed end, and a respective seat mounting plate.

4. The mechanism of claim 3, wherein the drive tube is substantially straight, and each drive tube mounting bracket includes a bend section spaced away from the respective seat mounting plate.

5. The mechanism of claim 3, wherein each opposed end of the drive tube has a forward bend section proximate each end thereof.

6. The mechanism of claim 3, wherein each linkage mechanism includes:

a front bell crank having first and second ends, the front bell crank pivotally coupled to the seat mounting plate at a mid-point generally midway between the first and second ends of the front bell crank;

an ottoman drive link having first and second ends, the first end of the ottoman drive link being pivotally coupled to the second end of the front bell crank; and a rear ottoman link having first and second ends, the rear ottoman link being pivotally coupled to the seat mounting plate at the first end, and being pivotally coupled to the second end of the ottoman drive link proximate the first end of the rear ottoman link, the second end of the rear ottoman link being pivotally coupled to an ottoman linkage, wherein forward movement of the seat mounting plate by the linear actuator causes rotation of the front bell crank, and forward movement of the ottoman drive link and rear ottoman link, resulting in movement of the seating unit from closed, to TV, to fully reclined positions.

7. The mechanism of claim 6, wherein the linear actuator is pivotally coupled to the midpoint of the drive tube.

8. A mechanism providing powered movement of a seating unit from a closed, to a TV, to a fully reclined position, the mechanism comprising:

a base;

a pair of spaced, opposed seat mounting plates;

a pair of linkage mechanisms that moveably interconnect the base and the seat mounting plates, the linkage mechanisms configured to move the seating unit between the closed, TV and fully reclined positions;

a drive tube having first and second ends, wherein each end of the drive tube is rigidly coupled to a respective seat mounting plate; and a linear actuator pivotally coupled on a first end to the base, and pivotally coupled on a second end to the drive tube, the coupling between the second end of the linear actuator and the drive tube and between the drive tube and the seat mounting plates causing movement of the seat mounting plate upon extension or retraction of the linear actuator, wherein, from the closed position of the seating unit, extension of the linear actuator causes forward movement of the drive tube and seat mounting plates, resulting in movement of the seating unit from a closed position to a TV position, and further extension of the linear actuator results in movement of the drive tube and seat mounting plates, resulting in movement from the TV position to the fully reclined position.

9. The mechanism of claim 8, further comprising a pair of drive tube mounting brackets rigidly secured between each drive tube opposed end, and a respective seat mounting plate.

10. The mechanism of claim 9, wherein the drive tube is substantially straight, and each drive tube mounting bracket includes a bend section spaced away from the respective seat mounting plate.

11. The mechanism of claim 8, wherein each opposed end of the drive tube has a forward bend section proximate each end of the drive tube.

12. The mechanism of claim 10, wherein each linkage mechanism includes:

a front bell crank having first and second ends, the front bell crank pivotally coupled to the seat mounting plate at a mid-point generally midway between the first and second ends of the front bell crank;

an ottoman drive link having first and second ends, the first end of the ottoman drive link being pivotally coupled to the second end of the front bell crank; and a rear ottoman link having first and second ends, the rear ottoman link being pivotally coupled to the seat mounting plate at the first end, and being pivotally coupled to the second end of the ottoman drive link proximate the first end of the rear ottoman link, the second end of the rear ottoman link being pivotally coupled to an ottoman linkage, wherein forward movement of the seat mounting plate by the linear actuator causes rotation of the front bell crank, and forward movement of the ottoman drive link and rear ottoman link, resulting in movement of the seating unit from closed, to TV, to fully reclined positions.

13. The mechanism of claim 12, wherein the linear actuator is pivotally coupled to the midpoint of the drive tube.

* * * * *